US008127387B2

(12) United States Patent
Tygh

(10) Patent No.: US 8,127,387 B2
(45) Date of Patent: Mar. 6, 2012

(54) MULTI-PURPOSE FIREFIGHTING TOOL

(76) Inventor: Daniel P. Tygh, Philadelphia, PA (US)

( * ) Notice: Subject to any disclaimer, the term of this patent is extended or adjusted under 35 U.S.C. 154(b) by 351 days.

(21) Appl. No.: 12/592,350

(22) Filed: Nov. 24, 2009

(65) Prior Publication Data

US 2011/0119836 A1 May 26, 2011

(51) Int. Cl.
*B66F 15/00* (2006.01)
*B25C 11/00* (2006.01)

(52) U.S. Cl. ..... 7/166; 254/25; 254/120

(58) Field of Classification Search ..... 7/144–146, 7/166; 254/25, 26 R, 120, 131
See application file for complete search history.

(56) References Cited

U.S. PATENT DOCUMENTS 170,972 A * 12/1875 Thayer ..... 7/145
790,973 A * 5/1905 Oliver ..... 254/26 R
3,710,407 A * 1/1973 Reid ..... 7/144
4,597,123 A * 7/1986 Cobe, Jr. ..... 7/138
4,785,488 A * 11/1988 Schellas ..... 7/166
5,315,724 A * 5/1994 Trujillo et al. ..... 7/145
7,565,711 B1 * 7/2009 Schamadan ..... 7/145
7,634,830 B2 * 12/2009 Ryan ..... 7/166

* cited by examiner

*Primary Examiner* — David B Thomas
(74) *Attorney, Agent, or Firm* — Stuart M. Goldstein

(57) ABSTRACT

A manually held firefighting tool has an elongated staff section having a first working member at one end and a second working member at the other end. The first working member has a claw element and a spike element, each extending perpendicular to the longitudinal axis of the staff section and protruding from the staff section in opposite directions. The second working member extends from the second end of the staff section and has a U-shaped yoke element supporting an arcuate cross bar element positioned parallel to the longitudinal axis of the staff section. The second working member has its own claw element at one end and a spike element at the other end. A flat bar element is affixed perpendicularly to the cross bar element between its two ends. The firefighting tool is configured to be used in a variety of firefighting applications, allowing the firefighter to carry a single tool rather than a multitude of tools performing different functions.

7 Claims, 5 Drawing Sheets

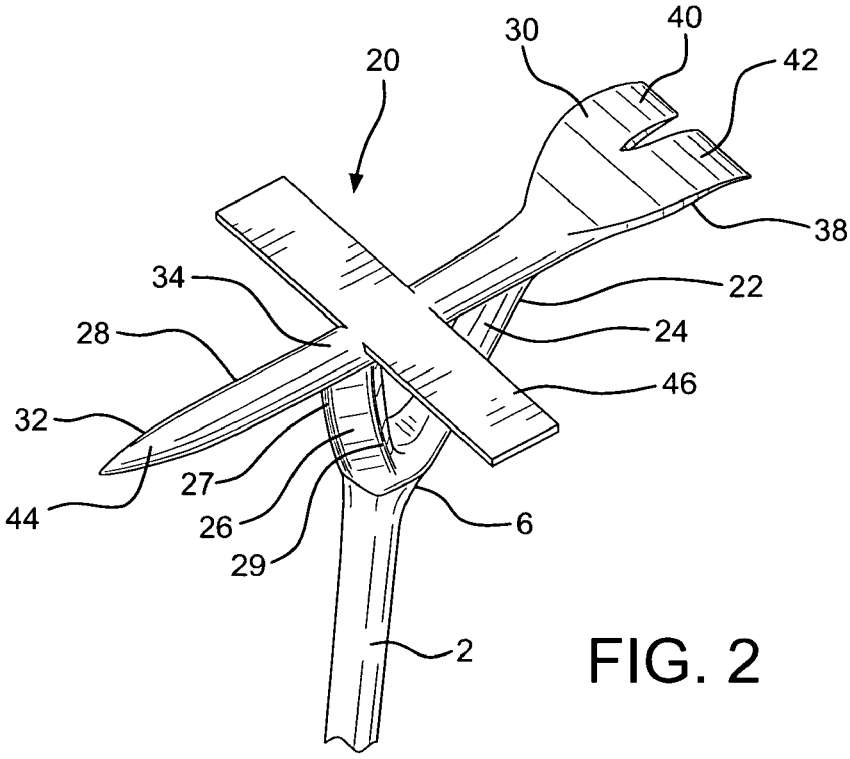
FIG. 2
FIG. 3
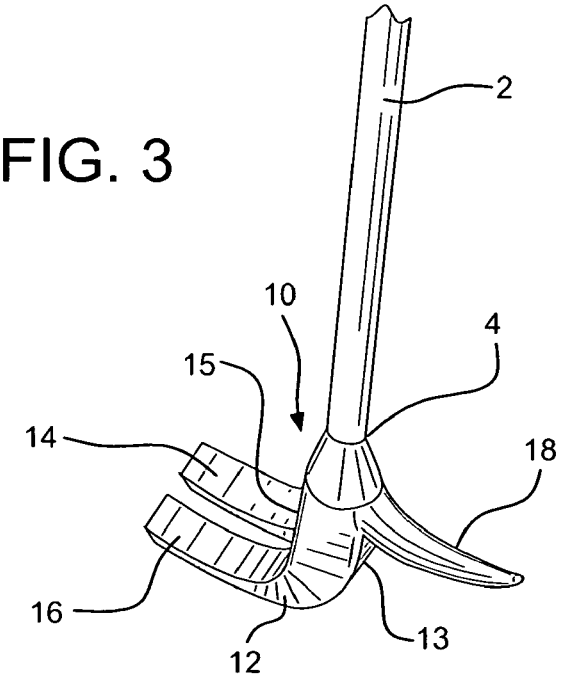

MULTI-PURPOSE FIREFIGHTING TOOL

BACKGROUND OF THE INVENTION

Firefighters often face dangerous, difficult, and unpredictable situations which require the use of manually held firefighting tools. Normally, several different types of tools are required to address the need to manually ventilate spaces, gain entry into burning structures or vehicles, pry or batter down doors, walls, and windows, penetrate locks and gates, rescue individuals, and perform a myriad of other tasks. Various tools are used for these purposes e.g. Halligan bars, pry axes, crowbars, flat bars, pike poles, padlock breakers, and others. However, there are very few practical, useable, handheld firefighter tools which are configured to perform multiple tool functions and none which have the versatility to be used in most tool related circumstances a firefighter will encounter.

SUMMARY OF THE INVENTION

The object of the present invention is to overcome the disadvantages and limitations of prior manually held firefighting tools by providing a single tool which is configured with the most desirable and practical features of existing tools. The firefighting tool of the present invention combines the aspects of ceiling hooks, drywall hooks, duckbill padlock breakers, pry bars, battering rams, wall picks, hay drags, rubbish rakes, spikes, baling hooks, clawed tools, and others. The subject tool is a striking, pushing, pulling, and prying tool all in one. Its claw, spike, and adz-like elements provide for new prying configurations, not found in other forcible entry tools. The length of the tool allows for better leverage and can easily be utilized by two firefighters for heavy prying, pulling and battering. Its extreme versatility allows the firefighter to carry a single tool with many functions, as opposed to the need for carrying many different types of tools.

These and other objects are accomplished by the invention, a manually held firefighting tool which comprises an elongated staff section having a first working member at one end and a second working member at the other end. The first working member has a claw element and a spike element, each extending perpendicular to the longitudinal axis of the staff section and protruding from the staff section in opposite directions. The second working member extends from the second end of the staff section and has a U-shaped yoke element supporting an arcuate cross bar element positioned parallel to the longitudinal axis of the staff section. The second working member has its own claw element at one end and a spike element at the other end. A flat bar element is affixed perpendicularly to the cross bar element between its two ends. The firefighting tool is configured to be used in a variety of firefighting applications, allowing the firefighter to carry a single tool rather than a multitude of tools performing different functions.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

BRIEF DESCRIPTION OF THE DRAWINGS

FIG. 2 is an isometric view of one of the working members of the firefighting tool of the present invention.

FIG. 3 is an isometric view of the other working member of the firefighting tool of the present invention.

DETAILED DESCRIPTION OF THE INVENTION

Figure 1:
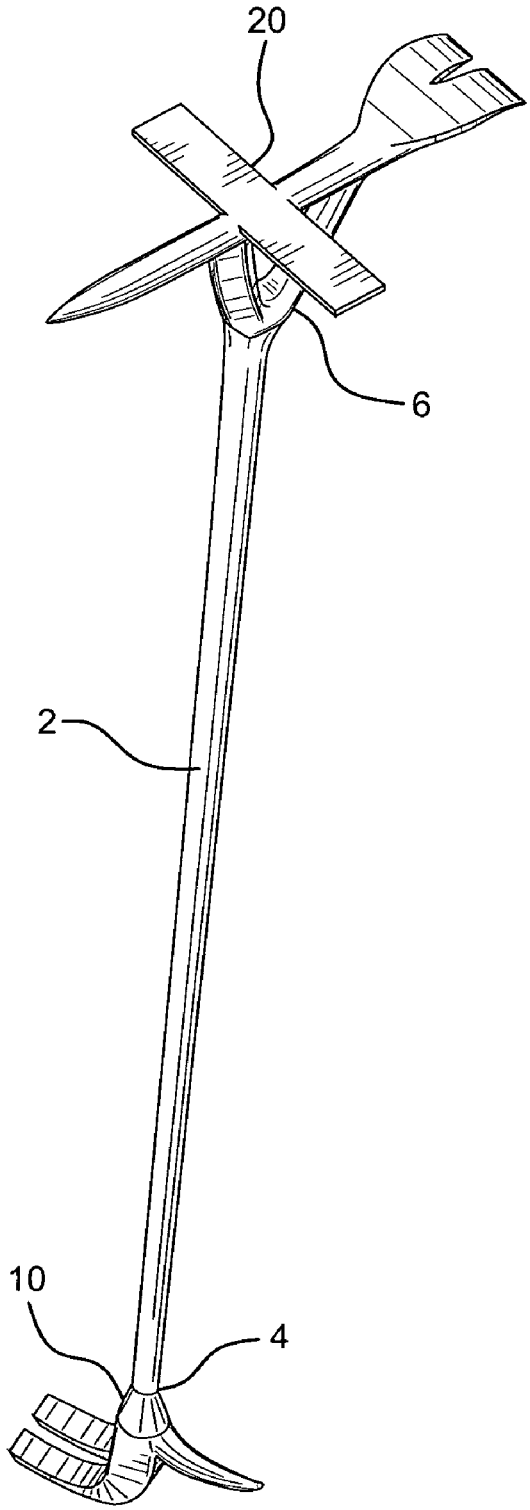
FIG. 1 is an isometric view of the firefighting tool of the present invention.

Firefighting tool 1 of the present invention comprises elongated rigid staff section 2 having opposing ends 4 and 6. Longitudinal axis 8 extends through the length of staff 2. It is anticipated that staff section will be approximately four to five feet in length. However, the invention is not to be restricted to this dimension.

Operative working member 10 is located on tool 1 at end 4 of staff section 2. Working member 10 comprises claw element 12 having arcuate arms 14 and 16. Claw element 12 protrudes substantially perpendicularly out from working member 10 and staff 2 in one direction, perpendicular to longitudinal axis 8, at approximately a 90° angle. Claw element 12 comprises substantially flat striking surfaces 13 and 15. Curved spike element 18 protrudes out from the other side of working member 10 and staff section 2 in the opposite direction of claw element 12, perpendicular to longitudinal axis 8, at approximately a 90° angle.

Operative working member 20 is located on tool 1 at end 6 of staff section 2. Working member 20 comprises substantially U-shaped yoke 22 having supporting yoke arms 24 and 26 projecting upwards from the top of staff section 2. The outer surface of yoke arm 24 is a flat striking surface. Yoke arm 26 has beveled cutting edges 27 and 29, as best seen in FIG. 2. Alternatively, in lieu of dual beveled cutting edges 27 and 29, the outer surface of yoke arm 26 can be wedge-shaped, having a raised central cutting edge with two tapered surfaces extending laterally down from the edge to the sides of the yoke arm.

Figure 4:
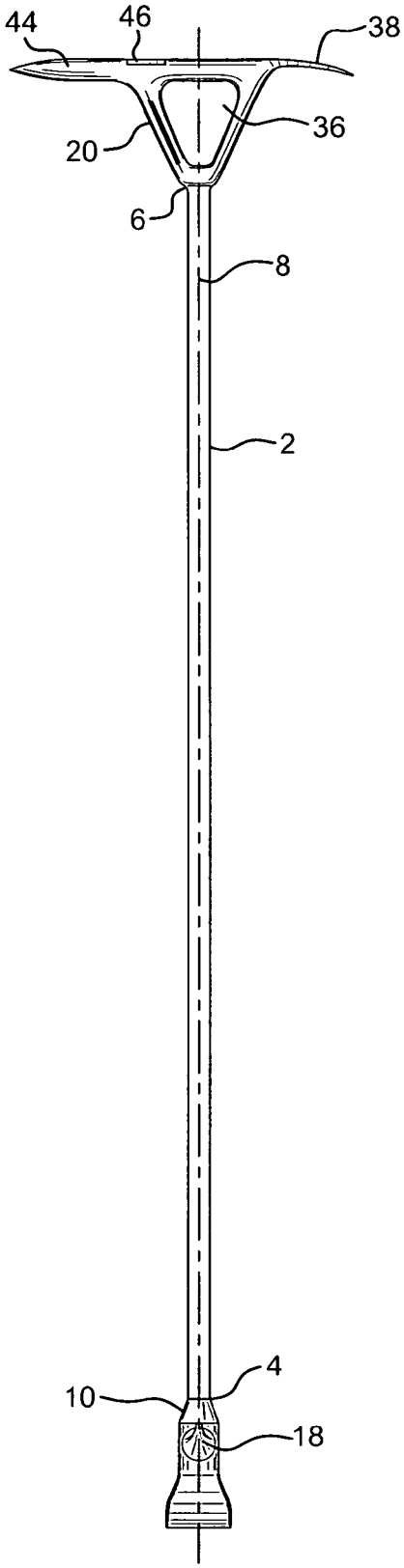
FIG. 4 is the front view of the firefighting tool of the present invention.
Figure 5:
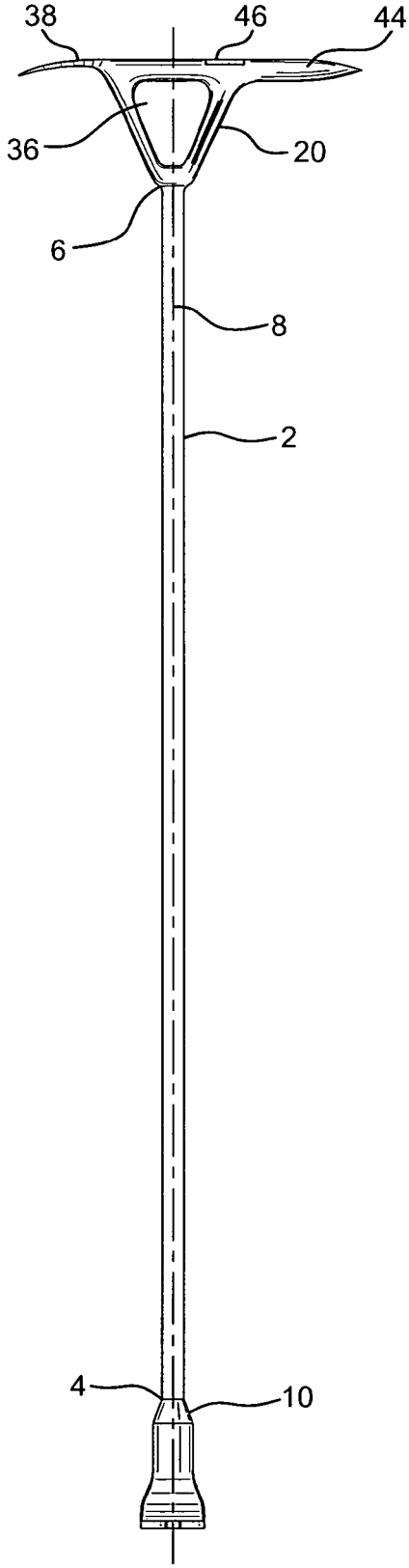
FIG. 5 is the rear view of the firefighting tool of the present invention.
Figure 6:
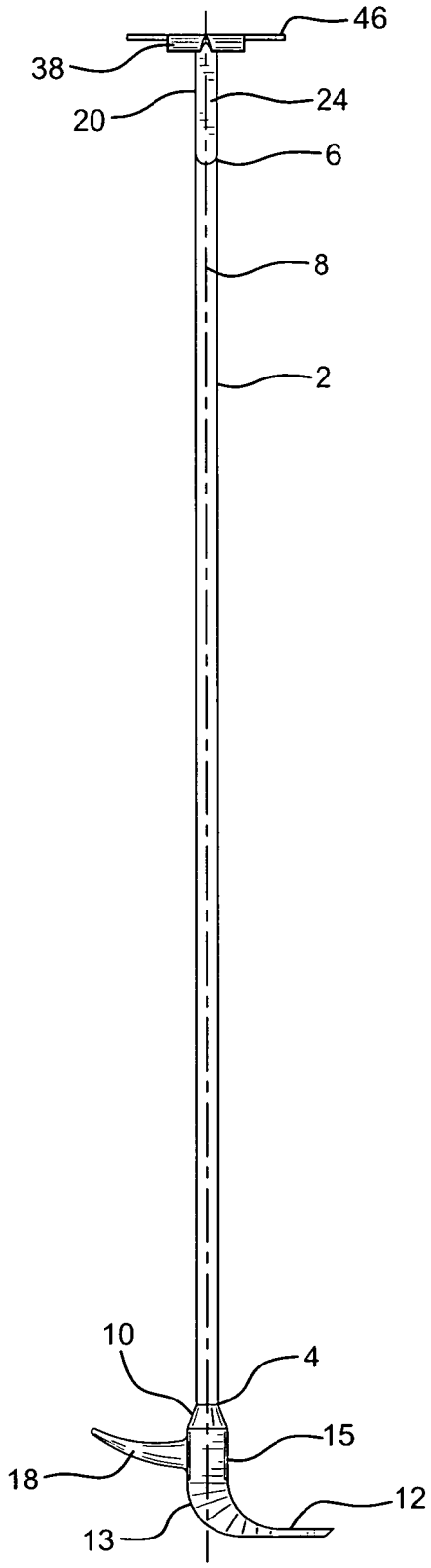
FIG. 6 is an elevation view of the firefighting tool of the present invention.
Figure 7:
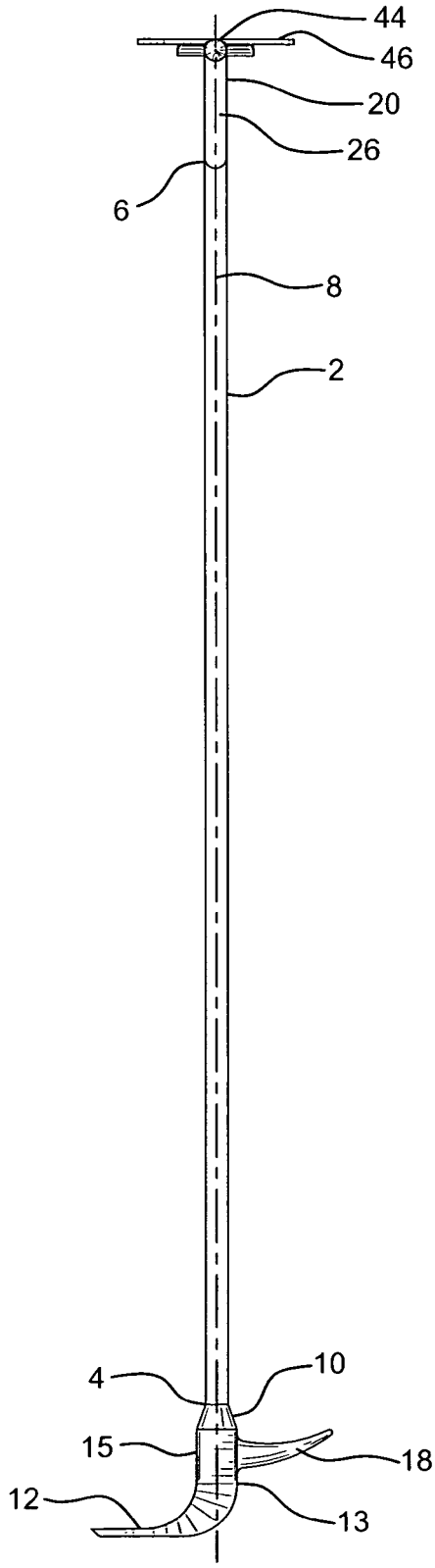
FIG. 7 is an elevation view showing the other side of the firefighting tool of the present invention.
Figure 8:
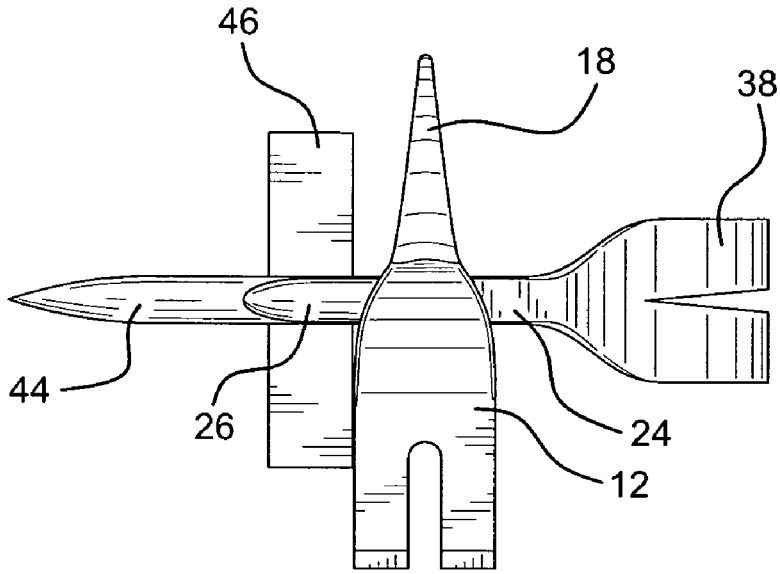
FIG. 8 is the bottom view of the firefighting tool of the present invention.
Figure 9:
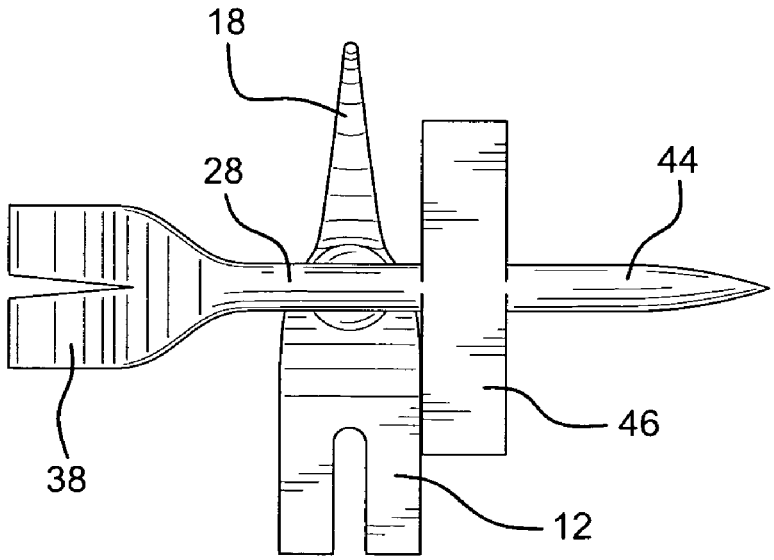
FIG. 9 is the top view of the firefighting tool of the present invention.

Yoke 22 is connected to cross bar element 28 having opposing ends 30 and 32 and intermediate section 34. Handle component 36, best seen in FIGS. 4 and 5, is formed by yoke 22 and intermediate section 34 of cross bar element 28, at end 6 of staff section 2. Claw element 38, with arcuate arms 40 and 42, is located at end 32 of cross bar element 28 and curved spike element 44 is located at end 30 of the cross bar element. Claw element 38 is angled differently than claw element 12 to assist in different tasks. Similarly, spike elements 18 and 44 are of different lengths and thicknesses for different applications and uses. Flat bar element 46 rests and is affixed perpendicularly to cross bar element 28, between ends 30 and 32 and over yoke arm 26.

The unique configuration of firefighting tool 1, with its working members 10 and 20 available on the ends of staff section 2, provides for a product which is extremely versatile for use in manual fire fighting and rescue operations.

For example, ventilation of effected spaces is routinely a critical concern in building fires. Removal and replacement of smoke, hot air, and toxic gases with cooler air allows for safer entry for firefighters and a better chance of survival for occupants in a burning structure. Horizontal ventilation, that is ventilation which occurs horizontally from a building, is readily accomplished utilizing tool 1 to break, batter in, and/or penetrate external windows, glass block windows, and doors variously using outside surfaces of working members 10 and 20, and spike elements 18 and 44. Tool 1 is also used to pry off or open doors, boarded up windows, awnings, burglar bars, eaves, and air conditioning units variously using claw elements 12 and 38 and spike elements 18 and 44.

Vertical ventilation takes place during vertically from a structure. It is accomplished by utilizing tool 1 to pry off and penetrate skylights, slate or wood shingles, and cellar doors variously using claw elements 12 and 38, spike elements 18 and 44, and flat bar element 46. Tool 1 is also used to lift and drag away cut sections of the roof and to open holes in the ceiling after roof sections are removed to prevent smoke and heat from being trapped by interior ceilings. This is accomplished by variously using working member 10 and its claw element 12 and spike 18 and all elements of working member 20 together, to drag, lift and remove structures and debris.

Tool 1 is additionally used for forcible entry; that is gaining access to a structure when it is locked, blocked off, or otherwise has no access. Using working members 10 and 20 with their individual operative elements, doors, windows, walls, burglar bars, and security gates can be pried open, battered in or penetrated through. For instance, spike 44, in conjunction with beveled cutting surfaces 27 and 29 or the alternate central raised cutting edge of yoke arm 26, can be efficiently compelled through a wall by striking the flat striking surface of yoke arm 24. In addition, spike elements 18 and 44, using claw elements 12 and 38, can pry and force open padlocks, hinges, doors and windows.

Firefighters are also called upon to address motor vehicle fires and accidents. Prying open car doors to gain entry into the occupant cabin space and prying and pulling off sheet metal or penetrating vehicle locks to access hood and trunk compartments are readily accomplished by working members 10 and 20 of tool 1. In addition, claw elements 12 and 38 are useful in removing vehicle battery terminals and flattening tires by removing tire valves. The length afforded to tool 1 by staff section 2 allows the tool to be used as a supporting strut as well.

When searching for hidden fires, smoke, heat or sparks to eliminate the chance of rekindling, tool 1, with its working members 10 and 20, can be variously utilized to penetrate and pull and pry open drywalled walls and ceilings, wood paneled walls and ceilings, roof shingles and siding, floor boards, baseboards, framework, and cabinets. Using handle 36 of tool 1, working member 10 can be employed for various purposes, including for general prying operations, battering solid surfaces to gain entry, or even reaching for items otherwise out of reach. Similarly, a firefighter grasping claw element 12 and spike 18 of working member 10, can use working member 20 in various capacities, not only described above, but also to penetrate, pry, pull, drag, lift, and rotate a safe distance away from a structure. This is especially critical when the firefighter cannot directly access a fire, smoke-filled, or other dangerous area.

Other miscellaneous uses for tool 1 with its respective working members 10 and 20, includes prying open elevator, train, and bus doors, pulling down fire escape stairs and ladders, lifting manhole covers and grates, as a rubbish rake or hay drag for rubbish and dumpster fires, for shutting off gas lines, or as an elongated baling hook to move bales, crates, boxes, barrels, etc. Tool 1 can further be employed as a anchor point for rope rescue or as a personal lifeline anchor means for egress through a door, window, floor, or roof. It can also be used as a foothold or, given the elongated nature of staff section 2, can be used as a handrail, especially on unlevel surfaces like pitched roofs. This is accomplished by driving either spike into the roof.

The elongated design of tool 1 also allows for better leverage in many of the situations described above and for two man operation in heavy prying applications. The length of tool 1, coupled with the configurations of working members 10 and 20, additionally allow tool 1 to be used for mounting a mobile attack line to relieve stress on firefighters or it can be propped up to be free-standing.

Built-in handle 36 of tool 1 makes it easier for use for pulling, prying, battering, etc. operations. Handle 36 also allows for better reach and efficiency when hung down and used to break windows from a rooftop, thus allowing an easier swinging motion to be achieved—especially given the heft of the tool. Handle 36 also provides the additional capability to use a webbing loop or rope to facilitate ease of carrying tool 1 when climbing a ladder or when additional reach is needed.

It is evident that tool 1 of the present invention has a unique and versatile configuration whose use is limited only by the imagination and requirements of the firefighter. While a number of uses and functions of tool 1 have been described herein, these uses and functions should not be considered restrictive or limiting in any manner. It is anticipated and contemplated that tool 1 of the present invention will be used in these and a multitude of other applications.

Tool 1 is a unitary body fabricated as a single member, or its components can be welded, forged or otherwise connected together. It is contemplated that tool 1 will be constructed of high strength materials, such as high strength steel, titanium, or other material capable of being used without failure during the many and various prying, battering, penetrating, pulling, pushing, lifting, cutting, breaking, striking, dragging, and supporting firefighting and rescue operations.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A multi-purpose firefighting tool comprising:

an elongated staff section having longitudinal axis and first and second opposing ends;

a first working member located on the first end of the staff section, said first working member comprising a claw element and a spike element, each element extending substantially perpendicular to the longitudinal axis of the staff section and protruding from the staff section in opposite directions; and a second working member located on the second end of the staff section, said second member comprising a substantially "U" shaped yoke element supporting an arcuate cross bar element having first and second opposing ends, the cross bar element being positioned substantially perpendicular to the longitudinal axis of the staff section and comprising a second claw element at one end and a second spike element at the second end, and a flat blade element affixed perpendicularly between the two ends of the cross bar element.

2. The multi-purpose firefighting tool as in claim 1 wherein both spike elements are curved.

3. The multi-purpose firefighting tool as in claim 1 wherein the tool is a unitary body.

4. The multi-purpose firefighting tool as in claim 1 wherein each claw element comprises two arcuate arms.

5. The multi-purpose firefighting tool as in claim 1 wherein the yoke element and the cross bar element form an enclosed handle at the second end of the second working member.

6. The multi-purpose firefighting tool as in claim 1 wherein the elongated staff section extends between the first working member and the second working member.

7. The multi-purpose firefighting tool as in claim 6 wherein the first working member is positioned on the staff section such that it is perpendicular in relation to the second working member.

* * * * *